US012274921B2

(12) United States Patent
Godoy

(10) Patent No.: US 12,274,921 B2
(45) Date of Patent: Apr. 15, 2025

(54) DEVICE FOR CONNECTING A SHOE TO AN INTERCHANGEABLE BLADE OF A FIN

(71) Applicant: CRESSI-SUB S.P.A., Genoa (IT)

(72) Inventor: Carlos Alberto Godoy, Genoa (IT)

(73) Assignee: CRESSI-SUB S.P.A., Genoa (IT)

( * ) Notice: Subject to any disclaimer, the term of this patent is extended or adjusted under 35 U.S.C. 154(b) by 524 days.

(21) Appl. No.: 17/724,796

(22) Filed: Apr. 20, 2022

(65) Prior Publication Data

US 2022/0339507 A1 Oct. 27, 2022

(30) Foreign Application Priority Data

Apr. 26, 2021 (IT) ..... 102021000010511

(51) Int. Cl.
*A63B 31/11* (2006.01)

(52) U.S. Cl.
CPC ..... *A63B 31/11* (2013.01); *A63B 2031/112* (2013.01); *A63B 2225/09* (2013.01)

(58) Field of Classification Search
CPC ..... A63B 31/08; A63B 31/10; A63B 31/11; A63B 2031/112; A63B 2225/09
See application file for complete search history.

(56) References Cited

U.S. PATENT DOCUMENTS 5,522,748 A * 6/1996 Cressi ..... A63B 31/11 441/64
5,542,865 A * 8/1996 Alvarez De Toledo ..... A63B 31/11 441/64
6,568,974 B2 * 5/2003 Semeia ..... A63B 31/11 441/64
9,943,727 B2 * 4/2018 Giovannotto ..... A63B 31/11

FOREIGN PATENT DOCUMENTS

FR 2332038 A1 * 6/1977
FR 2611509 A1 * 9/1988

* cited by examiner

*Primary Examiner* — Ajay Vasudeva
(74) *Attorney, Agent, or Firm* — TROUTMAN PEPPER LOCKE LLP

(57) ABSTRACT

A swim fin comprising an interchangeable blade having at least two longitudinal tabs along the longitudinal perimeter edges thereof, a shoe provided with at least two longitudinal members which extend forwards from the two opposite sides of the shoe, each of the longitudinal members having a longitudinal groove for a removable engagement with a corresponding one of the tabs, wherein the longitudinal groove extends up to a front end of the longitudinal member, wherein each of said longitudinal members has a front terminal made of a more rigid material than the remaining part of the longitudinal member and configured for a shape and force coupling with a corresponding one of the tabs.

14 Claims, 5 Drawing Sheets

DEVICE FOR CONNECTING A SHOE TO AN INTERCHANGEABLE BLADE OF A FIN

CROSS REFERENCE TO RELATED APPLICATIONS

This application claims benefit of priority to Italian Patent Application No. 102021000010511, filed Apr. 26, 2021, the entire contents of which are hereby incorporated by reference.

FIELD

The present invention relates to a device for connecting a shoe to an interchangeable blade of a swim fin.

BACKGROUND

Swim fins in which various interchangeable blades—differing in shape, size, materials and physical properties depending on the present activity of the swimmer or diver—can be associated with the shoe have been present on the market for some time.

Swim fins are known that have a shoe at the two sides of which two longitudinal members are fixed and extend, the longitudinal members being provided with a groove in which the blade is made to slide; the blade is traditionally fixed with two clips positioned along the longitudinal member which fasten the elastic material of the longitudinal member onto the blade in the cavities provided, thereby securing it.

As is known, in order to compensate for the different thicknesses of blades made with different materials, use is traditionally made of compensation spacers necessary to obtain an adequate fastening of the clips on the material of the longitudinal member and thus on the blade.

As is known, traditional swim fins with interchangeable blades thus have a critical aspect in terms of the adequate fastening of the clips on the blade, the continual alternating use of the fin by the swimmer, which may compromise the adequate stability and fixing to the shoe.

It is also known that the longitudinal member, traditionally used for fixing the blade and made of a material that is different from the materials with which the interchangeable blades are made, has different elastic characteristics, which may compromise the efficiency of the blade thrust.

A need is thus felt to improve and simplify the structure of a swim fin comprising an interchangeable blade of the known type.

SUMMARY

The technical task of the present invention, therefore, is to provide a swim fin comprising an interchangeable blade that enables the aforesaid technical drawbacks of the prior art to be eliminated.

Within the scope of this technical task, one object of the invention is to provide a swim fin comprising an interchangeable blade that has a simple, secure and reliable system for engaging the blade with the shoe.

Another object of the invention is to provide a swim fin comprising an interchangeable blade that has a system for engaging the blade to the shoe which is integrated and without any elements in addition to the longitudinal members.

Yet a further object of the invention is to provide a swim fin comprising an interchangeable blade wherein the longitudinal fixing member interferes with the characteristics of elasticity of the blade to a limited degree.

The technical task, as well as these and other objects, are achieved according to the present invention by providing a swim fin comprising an interchangeable blade having two longitudinal tabs along the two longitudinal perimeter edges thereof, a shoe provided with two longitudinal members which extend forwards from the two opposite sides of the shoe, each longitudinal member having a longitudinal groove for a removable engagement with a corresponding tab, said groove extending up to a front of said longitudinal member, characterised in that each longitudinal member has a front terminal made of a more rigid material than the remaining part of the longitudinal member and configured for a shape and force coupling with the corresponding tab.

In one embodiment, the front terminal is elastically deformable for snap fastening onto said tab.

In one embodiment, the front terminal is fastened in direct contact with said tab.

In one embodiment, the terminal is a piece indissolubly connected to the remaining part of the longitudinal member.

In one embodiment, the front terminal defines a front enlargement of said longitudinal member.

In one embodiment, the remaining part of the longitudinal member is longitudinally flexible.

Other features of the present invention are defined, moreover, in the subsequent claims.

BRIEF DESCRIPTION OF THE DRAWINGS

Additional features and advantages of the invention will become more apparent from the description of a preferred but not exclusive embodiment of a swim fin comprising an interchangeable blade according to the invention, illustrated by way of non-limiting example in the appended drawings, in which.

DETAILED DESCRIPTION

Figure 1:
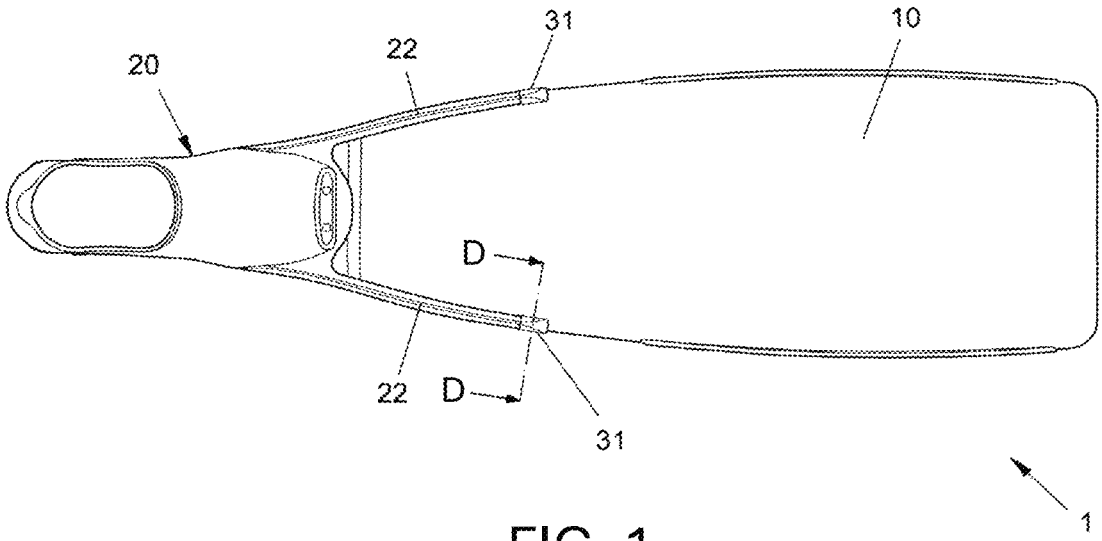
FIG. 1 shows a top view of the complete swim fin.
Figure 1A:
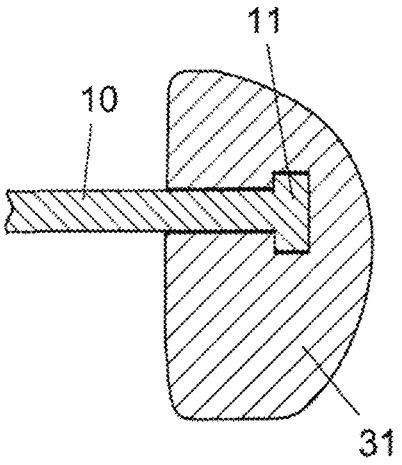
FIG. 1A shows a section along the plane DD of the fin in FIG. 1.
Figure 2:
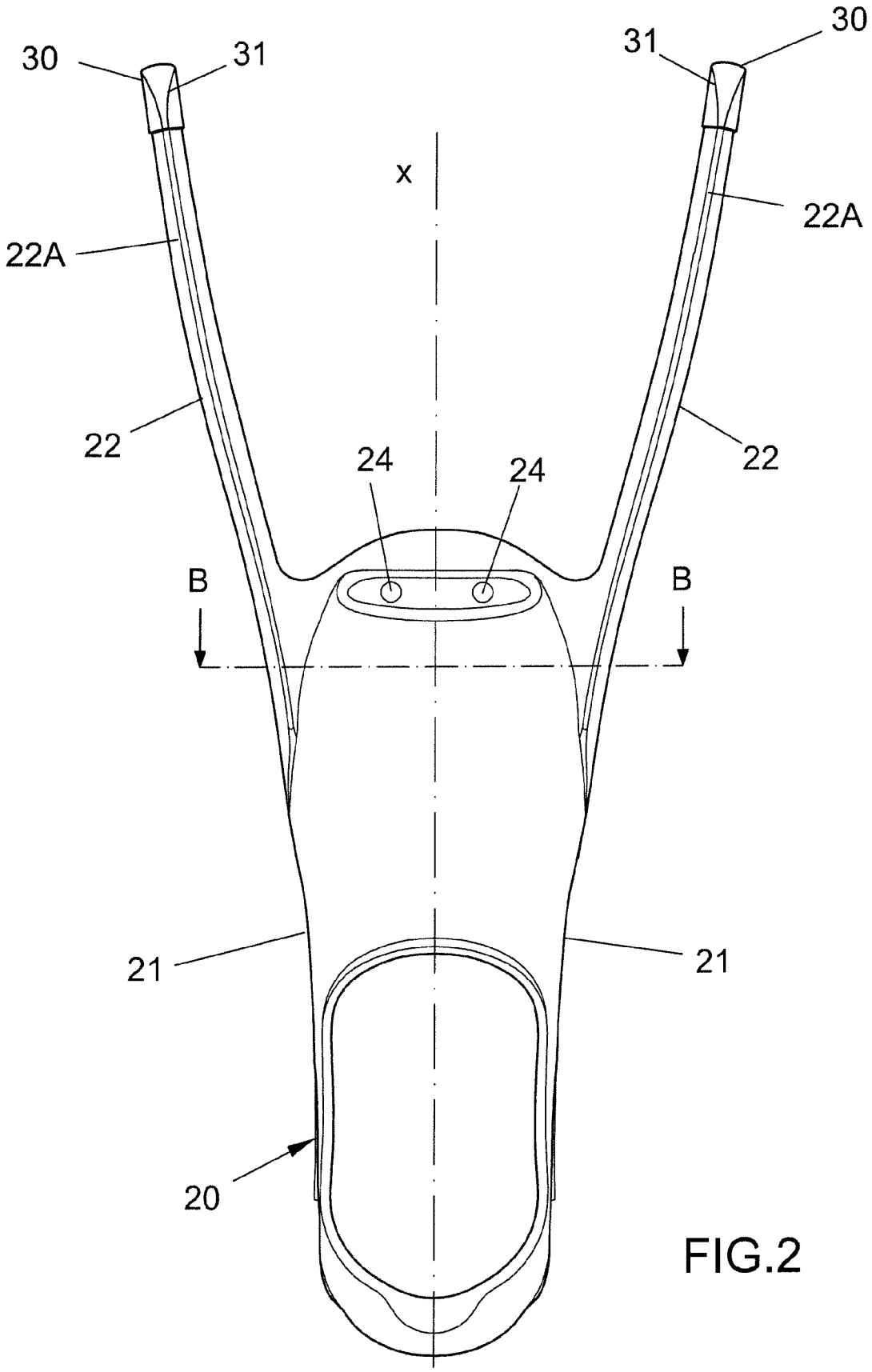
FIG. 2 shows a top view of the shoe.
Figure 2A:
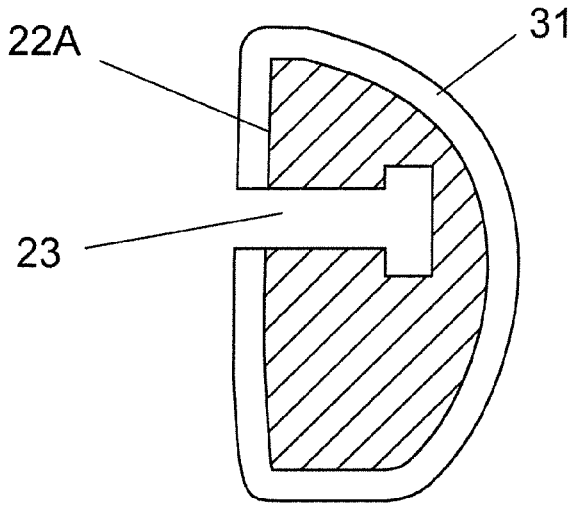
FIG. 2A shows a section along the plane AA of a longitudinal member of the shoe.
Figure 3A:
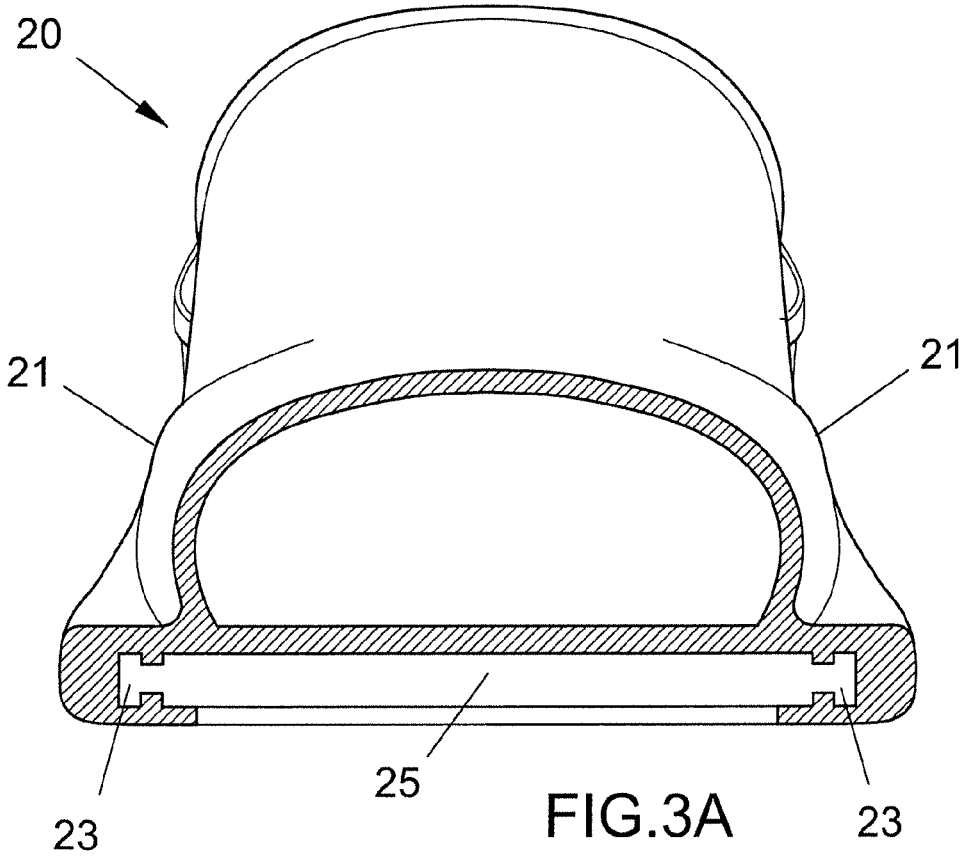
FIG. 3A shows a section along the plane BB of the shoe.
Figure 3:
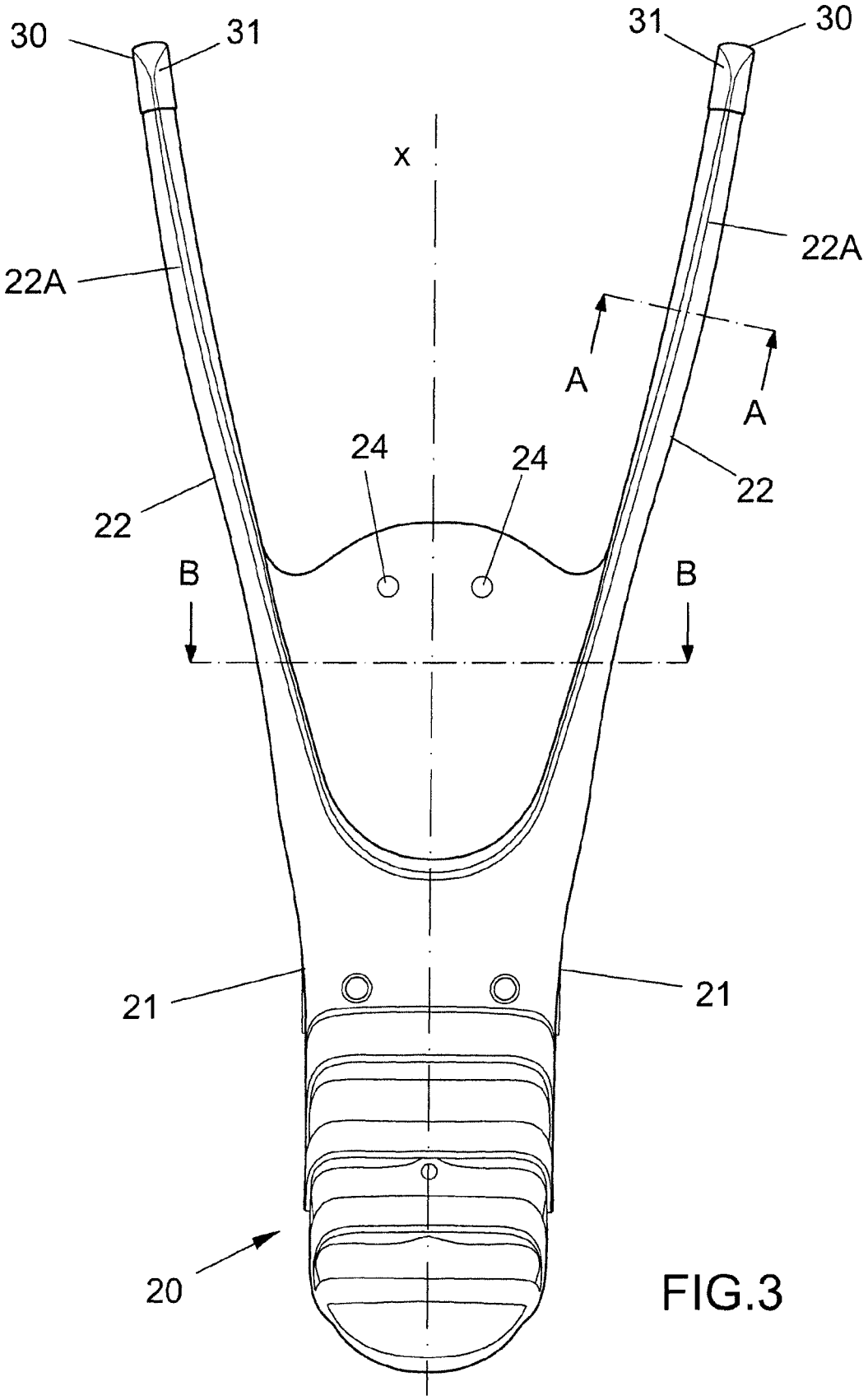
FIG. 3 shows a bottom view of the shoe.
Figure 4:
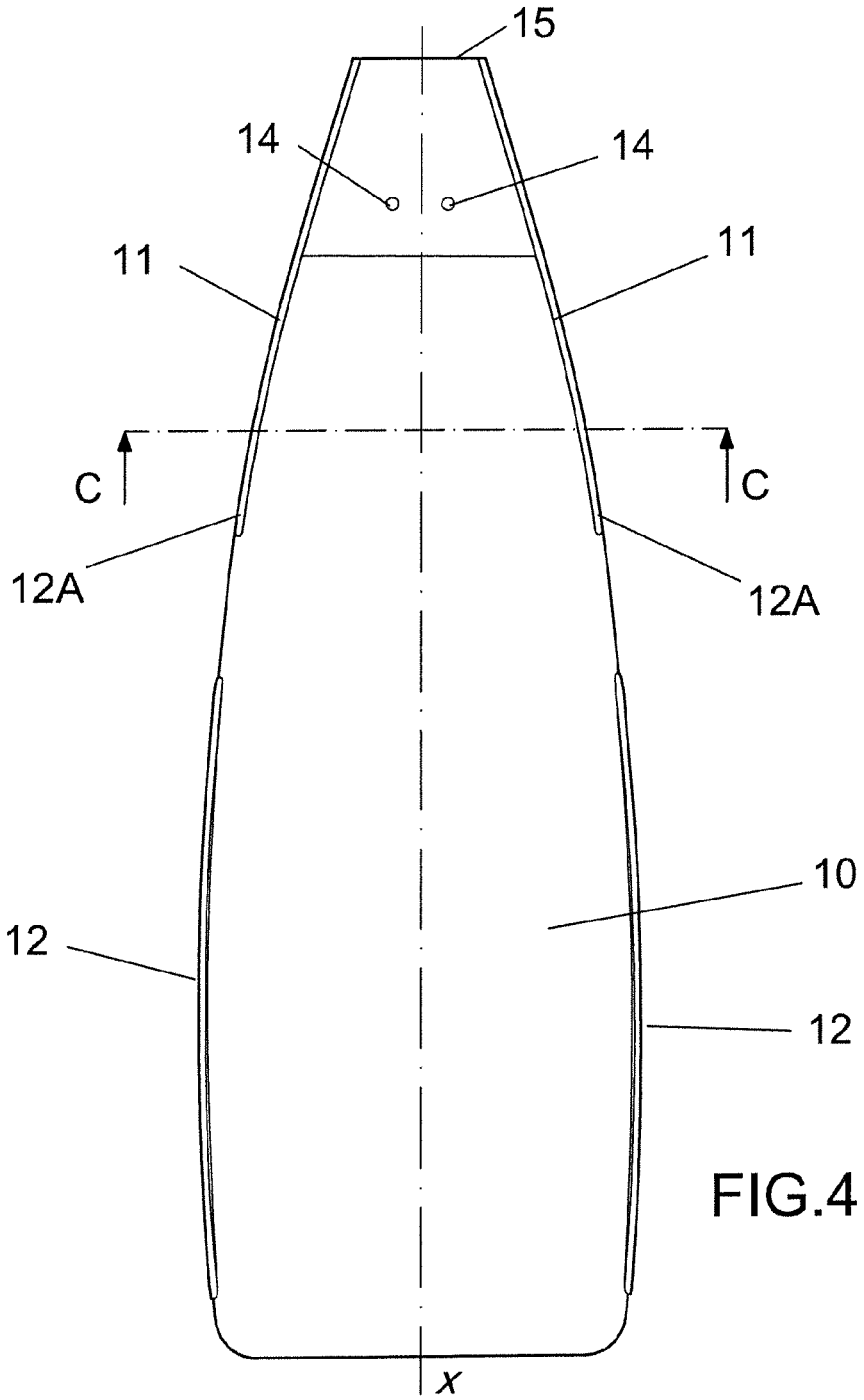
FIG. 4 shows a top view of the blade.
Figure 4A:
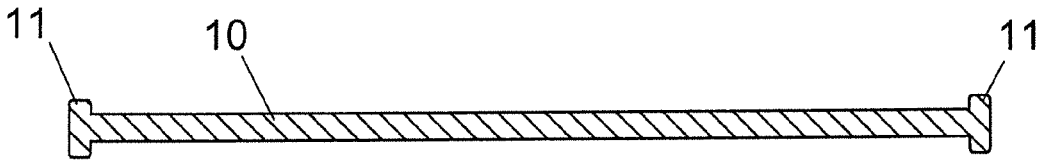
FIG. 4A shows a section along the plane CC of the blade.

With reference to the above-mentioned figures, they show a swim fin 1, denoted in its entirety with the reference number 1.

The swim fin 1 comprises the interchangeable blade 10 and a shoe 20.

Typically, the swim fin 1 exhibits a substantial symmetry relative to a longitudinal axis X.

The interchangeable blade 10 is made in different sizes and designs and of different materials, according to choice and the type of activity engaged in by the user/swimmer/diver.

Typically, the interchangeable blade 10 is made of polymeric plastic material, or of composite material, typically fibreglass or carbon fibre.

The interchangeable blade 10 has at least two longitudinal tabs 11 along the two longitudinal perimeter edges 12 thereof for at least a portion 12A corresponding to a portion 22A for removably engaging with two longitudinal members 22, which are symmetric with respect to the longitudinal axis X, and which extend forward from the two opposite sides 21 of the shoe 20.

Conveniently, the portion 12A of the interchangeable blade 10 and the portion 22A of the longitudinal member 22 have mating shapes.

Advantageously, the longitudinal member 22 has a shorter length than the blade 10.

Advantageously, each longitudinal member 22 has a longitudinal groove 23 for the portion 22A for removably engaging with a corresponding tab 11 of the blade 10. Typically, the longitudinal groove 23 has a cross section with a "T" configuration, which mates with the configuration of the cross section of the longitudinal tab 11 of the blade 10.

The longitudinal groove 23 extends forward to the front end 30 of the longitudinal member 22, and rearward to the abutment head 25 of the shoe 20.

Each longitudinal member 22 has, at the front end 30 thereof, a front terminal 31 made of a more rigid material, typically a polypropylene-based material, compared to the remaining part of the longitudinally flexible longitudinal member, which is typically made with a technical copolymer-based material.

Conveniently, moreover, the shoe 20 has, in the fitted part, at least one area made of a less rigid material than the longitudinal members 22.

Conveniently, the longitudinal groove 23 continues in the front terminal 31.

Advantageously, the front terminal 31 is configured for a shape and force coupling with the corresponding tab 11 of the blade 10.

Conveniently, the front terminal 31 is elastically deformable for snap fastening onto the tab 11: advantageously, the front terminal 31 fastened in direct contact with the tab 11.

The front terminal 31 defines an enlargement of the longitudinal member 22 at the front end 30 thereof, and appears as a piece indissolubly connected to the remaining part of the longitudinal member 22, typically as an added piece, typically as a glued or moulded piece.

In proximity to the root 15, the blade 10 has at least a pair of holes 14 which are symmetric with respect to the X axis and suitably configured to be located in a position such as to mate with at least a pair of holes 24 in the sole of the shoe 20 when the blade 10 is coupled to the shoe 20.

A suitable removable connection means securely fixes the root 15 of the blade 10 to the sole of the shoe 20 through the pairs of holes 14 and 24; typically, the removable connection means comprises a suitably shaped plate.

The method for assembling a swim fin comprising an interchangeable blade and a shoe according to the invention appears clear from what has been described and illustrated and, in particular, it is substantially the following.

The blade 10 is brought frontally near the shoe 20, and the tabs 11 are engaged with the longitudinal groove 23 in the front portions 22 A of the longitudinal members 22.

The blade 10, with the tabs 11 thus engaged, is made to slide along the longitudinal groove 23 until reaching the final fixing position, when the root 15 of the blade 10 reaches the abutment head 25 of the shoe 20.

In the final fixing position, the front terminals 31 of the longitudinal members 22 are elastically neared to the blade 10, and snap fastened by pressing onto the tabs 11.

The greater rigidity of the front terminal 31 compared to the front portion 22 A of the longitudinal member 22 ensures a precise fastening of the front terminal 31 on the tab 11 and thus of the longitudinal member 22 on the blade 10.

In the final fixing position, the pair of holes 14 at the root 15 of the blade 10 are in a position corresponding to that of the holes 24 of the sole of the shoe 20, and with a suitably configured and mounted plate a further safety fixing of the blade 10 to the shoe 20 is obtained.

To disassemble the blade 10 from the shoe 20, one disengages the terminal 31 from the tab 11 of the blade 10 with a simple twisting of the front terminal 31 and—once the safety fixing plate has been removed—the blade 10 is pulled out of the longitudinal groove 23, thus becoming free of the shoe 20.

It has in practice been ascertained that a swim fin comprising an interchangeable blade and a shoe according to the invention is particularly advantageous in that it has an integrated system for engaging the blade to the shoe, without any elements in addition to the longitudinal members.

A further advantage of a swim fin comprising an interchangeable blade and a shoe according to the invention is that the longitudinal fixing member interferes to a limited degree with the characteristics of elasticity of the blade.

The length of the longitudinally flexible part of the longitudinal member 22 can in fact be reduced to less than half of the length of the shoe.

Yet another advantage of the invention is that of providing a swim fin comprising an interchangeable blade that has a simple, secure and reliable system for engaging the blade to the shoe.

A swim fin comprising an interchangeable blade and a shoe thus conceived is susceptible of numerous modifications and variants, all falling within the scope of the inventive concept, as defined by the claims; moreover, all the details may be replaced with technically equivalent elements.

The materials used, as well as the dimensions, may in practice be any whatsoever according to needs and the state of the art.

What is claimed is:

1. A swim fin comprising an interchangeable blade having at least two longitudinal tabs along longitudinal perimeter edges thereof, a shoe provided with at least two longitudinal members which extend forwards from two opposite sides of said shoe, each of said longitudinal members having a longitudinal groove for a removable engagement with a corresponding one of said tabs, said longitudinal groove extending up to a front end of said longitudinal member, wherein each of said longitudinal members has a front terminal made of a more rigid material than the remaining part of said longitudinal member, said front terminal being configured for a shape and force coupling with a corresponding one of said tabs and being fastened in direct contact with said corresponding tab.

2. The swim fin according to claim 1, wherein said front terminal is elastically deformable for snap fastening onto said tab.

3. The swim fin according to claim 1, wherein said front terminal defines a front enlargement of said longitudinal member.

4. The swim fin according to claim 1, wherein said remaining part of said longitudinal member is longitudinally flexible.

5. The swim fin according to claim 1, wherein said front terminal is a piece that is indissolubly connected to said remaining part of said longitudinal member.

6. The swim fin according to claim 1, wherein said front terminal is a piece that is applied on said remaining part of said longitudinal member.

7. The swim fin according to claim 1, wherein said front terminal is glued or moulded onto said remaining part of said longitudinal member.

8. The swim fin according to claim 1, wherein said front terminal is made of a polypropylene-based material.

9. The swim fin according to claim 1, wherein said remaining part of said longitudinal member is made of a technical copolymer-based material.

10. The swim fin according to claim 1, wherein said groove has a "T"-shaped cross section.

11. The swim fin according to claim 1, wherein said shoe has, in the fitted part, at least one area made of a less rigid material than said longitudinal members.

12. The swim fin according to claim 1, wherein it has a fixing plate for fixing a root of said blade to said shoe.

13. The swim fin according to claim 1, wherein said blade is made of carbon fibre.

14. A method for assembling the fin in accordance with claim 1, wherein the tabs of the blade are first made to slide along the grooves of the remaining parts of the longitudinal members and, after a final position for fixing the blade to the shoe, the front terminals of said longitudinal members are snap fastened onto said tabs of said blade.

* * * * *